US008397320B2

(12) United States Patent
Capaldi

(10) Patent No.: US 8,397,320 B2
(45) Date of Patent: Mar. 19, 2013

(54) PATIENT LIFTING DEVICE

(76) Inventor: Guido Capaldi, Farmington, MI (US)

( * ) Notice: Subject to any disclaimer, the term of this patent is extended or adjusted under 35 U.S.C. 154(b) by 173 days.

(21) Appl. No.: 12/977,238

(22) Filed: Dec. 23, 2010

(65) Prior Publication Data

US 2012/0159706 A1 Jun. 28, 2012

(51) Int. Cl.
*A61G 7/10* (2006.01)

(52) U.S. Cl. ..... 5/85.1; 5/83.1; 5/87.1; 5/89.1

(58) Field of Classification Search ..... 5/85.1, 5/83.1, 87.1, 89.1; 212/327, 324, 205
See application file for complete search history.

(56) References Cited

U.S. PATENT DOCUMENTS

| | | | | |
|---|---|---|---|---|
| 2,688,410 | A * | 9/1954 | Nelson | 212/343 |
| 4,243,147 | A * | 1/1981 | Twitchell et al. | 212/284 |
| 4,334,480 | A | 6/1982 | Wallace | |
| 4,372,452 | A | 2/1983 | McCord | |
| 4,642,824 | A | 2/1987 | Hodges | |
| 4,680,030 | A * | 7/1987 | Coates et al. | 604/391 |
| 4,944,056 | A * | 7/1990 | Schroeder et al. | 5/85.1 |
| 5,072,840 | A * | 12/1991 | Asakawa et al. | 212/312 |
| 5,115,747 | A | 5/1992 | Teissier et al. | |
| 5,147,051 | A | 9/1992 | Liljedahl | |
| 5,158,188 | A * | 10/1992 | Nordberg | 212/312 |
| 5,337,908 | A | 8/1994 | Beck, Jr. | |
| 5,511,256 | A | 4/1996 | Capaldi | |
| 5,694,654 | A * | 12/1997 | Roy | 5/83.1 |
| 5,809,591 | A | 9/1998 | Capaldi et al. | |
| 6,009,576 | A * | 1/2000 | Gramme et al. | 5/413 R |
| 6,575,100 | B2 | 6/2003 | Faucher et al. | |
| 6,637,610 | B1 * | 10/2003 | Cheeseboro | 212/327 |
| 6,928,674 | B2 * | 8/2005 | Blackburn | 5/482 |
| 7,114,204 | B2 | 10/2006 | Patrick | |
| 7,181,789 | B2 * | 2/2007 | Gatten | 5/494 |
| 7,246,392 | B2 * | 7/2007 | Schmid et al. | 5/655 |
| 7,587,769 | B1 * | 9/2009 | McDermott | 5/494 |
| 2003/0084508 | A1 * | 5/2003 | Faucher et al. | 5/81.1 R |
| 2004/0158925 | A1 * | 8/2004 | Sims | 5/494 |
| 2004/0216230 | A1 * | 11/2004 | Blackburn | 5/482 |
| 2006/0010600 | A1 * | 1/2006 | Kendy | 5/482 |
| 2006/0260502 | A1 | 11/2006 | Hjort | |
| 2007/0056098 | A1 * | 3/2007 | Schmid et al. | 5/482 |
| 2009/0077737 | A1 * | 3/2009 | Dyhr et al. | 5/85.1 |
| 2009/0199335 | A1 * | 8/2009 | Guldmann | 5/87.1 |
| 2009/0249526 | A1 * | 10/2009 | Carangelo | 2/69.5 |
| 2010/0071709 | A1 * | 3/2010 | Grissom | 128/870 |
| 2011/0000015 | A1 * | 1/2011 | Faucher et al. | 5/83.1 |

* cited by examiner

*Primary Examiner* — Robert G Santos
*Assistant Examiner* — Brittany Wilson
(74) *Attorney, Agent, or Firm* — Dickinson Wright PLLC

(57) ABSTRACT

The patient lifting device includes a transverse beam that supports a movable lift assembly to move a patient relative to at least one of a bed or chair. The transverse beam spans between a pair of support structures and allows the lift assembly to move horizontally along the transverse beam to move the patient horizontally relative to the bed or chair. At one of the transverse beam ends, the lift assembly contacts a charging station. The charging station charges a battery, that is carried by the lift assembly, to power the lift assembly. The lift assembly is powered to move a patient vertically upward and downward. A power source is electrically coupled to the charging station to provide electrical power to charge the battery of the lift assembly through the charging station.

22 Claims, 5 Drawing Sheets

PATIENT LIFTING DEVICE

BACKGROUND OF THE INVENTION

1. Field of the Invention

A patient lifting device for moving a patient relative to a bed or chair.

2. Description of the Prior Art

Devices have been proposed in the prior art for use in lifting invalid patients from a bed for movement about a room. As an example, there is a need to lift invalid patients from their beds for cleaning the patient, transferring the patient to a wheelchair, gurney, etc., or for the use of a toilet.

Some patient lifting devices include a trolley-carrying-track spanning towers that are permanently affixed to an interior room. The trolley-carrying-track guides a take-up motor that lifts a patient from a bed or chair, for example. These patient lifting devices are difficult to move, difficult to adjust, and expensive to manufacture. Further, the take-up motor includes permanently attached cables that electrically power the motor. These cables are bulky and difficult to manipulate as the motor moves along the trolley-carrying-track. These patient lifting devices can be high voltage systems.

Patient lifting devices have not been directed to allow for easy charging of the batteries for the patient lifting devices. Patient lifting devices are not constantly used, but must be charged and ready to go when needed. When it becomes necessary to lift the patient, it is not practical to await a period of time for recharging the batteries.

SUMMARY OF THE INVENTION

The subject invention provides for a patient lifting device that moves a patient relative to a bed or chair. The patient lifting device includes a first support structure and a second support structure that is spaced from the first support structure. A transverse beam that extends between a first beam end and a second beam end is secured between the first and second support structures. One of the first and second beam ends of the transverse beam engages one of the first and second support structures and the other of the first and second beam ends engages the other of the first and second support structures. An open area for placement of the patient is defined between the transverse beam, the first support structure and the second support structure. A lift assembly, disposed for movement along the transverse beam, extends downwardly from said transverse beam to move the patient. The lift assembly is capable of horizontal movement along the transverse beam and vertical movement relative to the transverse beam to move the patient disposed in the open area. The lift assembly includes a battery that is disposed therein. The battery is capable of receiving a charge to power the lift assembly and move the patient disposed in the lift assembly vertically upward and downward. A charging station is disposed at one of the first and second ends of the transverse beam to receive the lift assembly and charge the battery of the lift assembly when the lift assembly is not in use.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
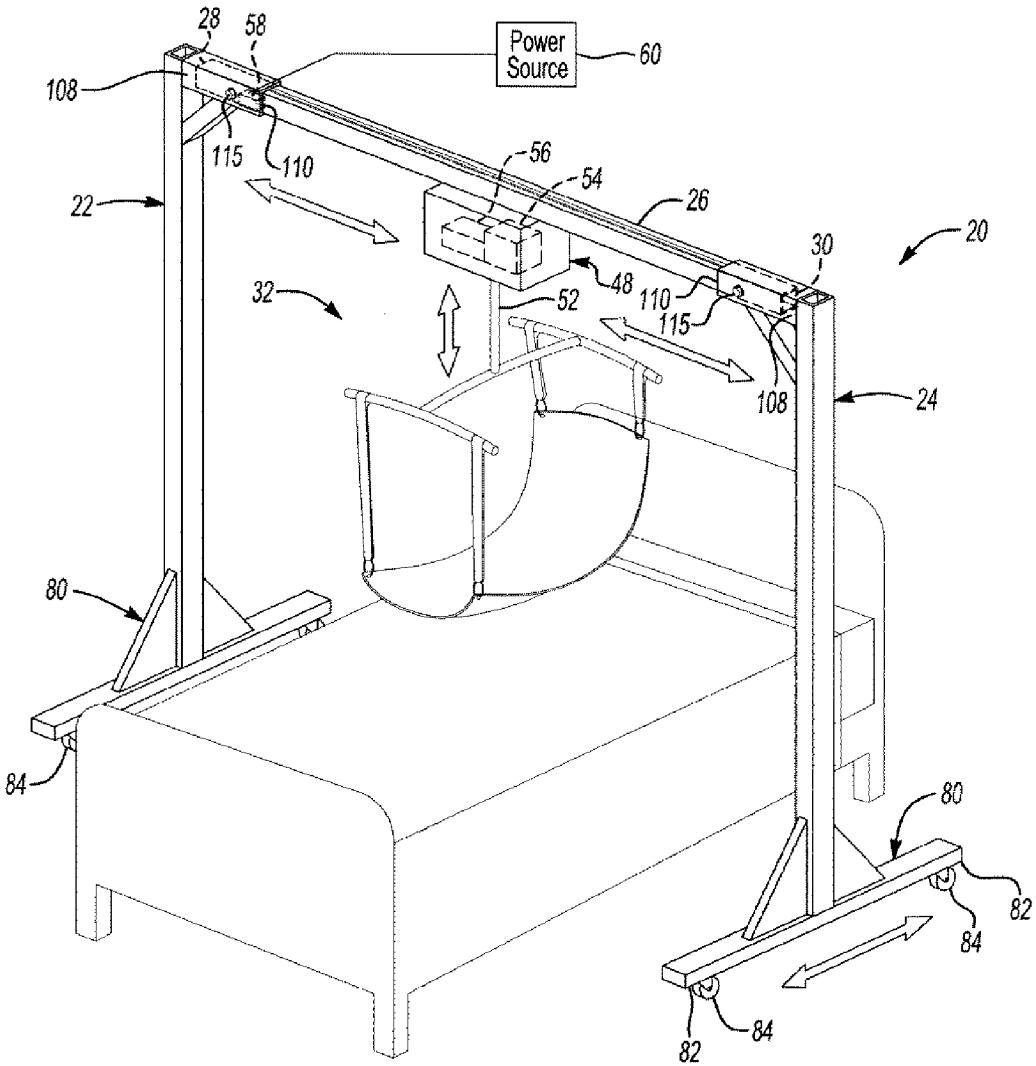
FIG. 1 is a perspective view of an exemplary patient lifting device having first and second support structures of a standard height according to the subject invention.

Referring to the Figures, wherein like numerals indicate corresponding parts throughout the several views, a patient lifting device 20 to move a patient relative to a bed or chair is generally shown.

The patient lifting device 20 is manufactured primarily from light weight aluminum. In one example, the aluminum portions are anodized with a satin finish. As known, such a finish facilitates cleaning. The patient lifting device 20 provides for a simplified unit that is cost effective, easy to work with, easy to assembly, and easy to maintain.

The patient lifting device 20 includes a first support structure 22 and a second support structure 24 that is spaced from the first support structure 22. A transverse beam 26, that extends between a first beam end 28 and a second beam end 30, is supported between the first and second support structures 22, 24. One of the first and second beam ends 28, 30 engages one of the first and second support structures 22, 24 while the other of the first and second beam ends 28, 30 engages the other of the first and second support structures 22, 24. When assembled, the transverse beam 26 and the first and second support structures 22, 24 define an open area 32 therebetween for placement of the patient. The open area 32 may receive at least one of a bed or chair for placement of the patient.

Figure 5:
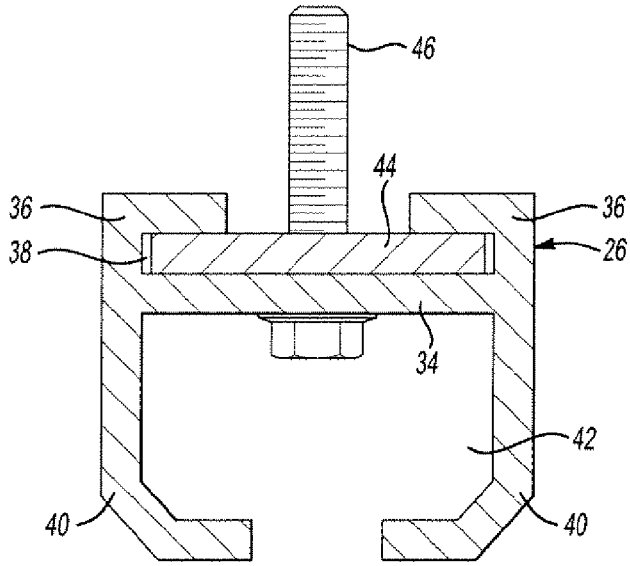
FIG. 5 is a cross-sectional view taken along the line 5-5 in FIG. 2 showing a support plate and a mechanical fastener extending therefrom to engage a permanent structure according to the subject invention.
Figure 8:
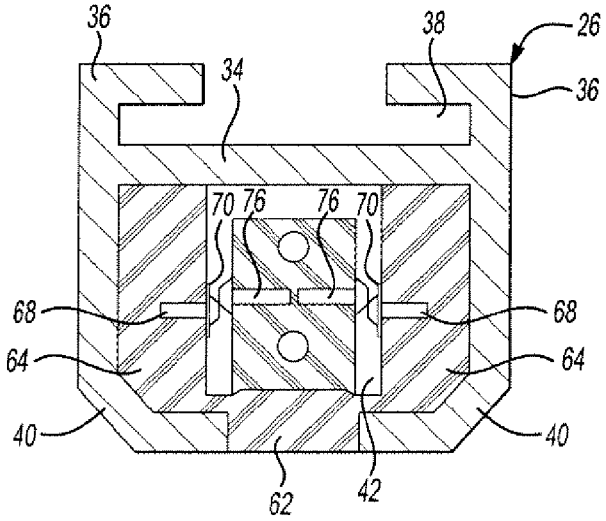
FIG. 8 is a cross sectional view of the transverse beam showing the plastic extension of the lift assembly engaged with the charging station in the second channel to charge the battery of the lift assembly according to the subject invention.

The transverse beam 26, as best seen in FIGS. 5 and 8, includes a beam portion 34 that extends horizontally between the first and second beam ends 28, 30. A pair of upwardly extending flanges 36 extend upwardly from the beam portion 34 between the first and second beam ends 28, 30 to define a first channel 38. A pair of downwardly extending flanges 40 extend downwardly from the beam portion 34 between the first and second beam ends 28, 30 to define a second channel 42 between the first and second beam ends 28, 30.

The patient lifting device 20 may include a support plate 44 that is secured within the first channel 38 to secure the transverse beam 26 to a permanent structure, such as a ceiling. In such an embodiment, a mechanical fastener 46 mates with both the support plate 44 and the permanent structure to secure the transverse beam 26 to the permanent structure. The mechanical fastener 46 may be any fastener known in the art to secure one structure to another.

The patient lifting device 20 includes a lift assembly 48 to move the patient within the open area 32. This movement can include raising or lowering a patient into and out of a bed or chair. The lift assembly 48 engages the transverse beam 26 and is capable of both horizontal movement along the transverse beam 26 and vertical movement relative to the transverse beam 26 to move the patient disposed in the open area 32. The lift assembly 48 may be slid along the transverse beam 26 manually by a user. In addition, the user can control the vertical movement of the lift assembly 48 through a control mechanism that raises and lowers the a portion of lift assembly 48 relative to the transverse beam 26.

In the exemplary embodiment, the lift assembly 48 engages the transverse beam 26 within the second channel 42 to control the horizontal movement of lift assembly 48 along the transverse beam 26. The lift assembly 48 includes a plurality of assembly wheels 50 that are disposed within the second channel 42 of the transverse beam 26 to guide the lift assembly 48 horizontally along the second channel 42 of the transverse beam 26. The use of the assembly wheels 50 allow the user to slide the lift assembly 48 horizontally along the second channel 42. In the exemplary embodiment, the lift assembly 48 includes eight assembly wheels 50, but any numbers of wheels may be used.

The lift assembly 48 includes a lift strap 52 that extends downwardly therefrom. The lift strap 52 may be attached to the patient to raise or lower the patient relative to the transverse beam 26. A motor 54 is disposed with the lift assembly 48 and powers the lift strap 52 to move the lift strap 52 upwardly and downwardly. A remote control may be electrically connected to the motor 54 to control the motor 54 and thus the upward and downward movement of the lift strap 52. The remote control may include a toggle switch that controls the vertical movement of the lift strap 52.

A battery 56 that is rechargeable is disposed within the lift assembly 48 to power the motor 54. The battery 56 is a 24-volt power supply, such as two, 12-volt batteries, connected in series, but the battery 56 may be modified to include any battery 56 known in the art that is rechargeable and capable to power a motor 54 to lift a patient.

In the exemplary embodiment, the lift assembly 48 includes a kill switch that limits the upward movement of the lift strap 52 and the patient secured thereto. The kill switch interacts with a disk portion that is secured to the lift strap 52 to stop the motor 54, and thus its upward movement, when the disk portion engages the kill switch.

A lift bar is secured to the lift strap 52. The lift bar may be a four-point lift bar that includes four-points to engage the lift strap 52 to provide for a more stable environment to move the patient. A sling is secured to the lift bar to support the patient during the moving of the patient. The sling is adjustable to accommodate multiple body configurations.

During operation, the lift assembly 48 slides horizontally along the transverse beam 26 to engage a charging station 58. The lift assembly 48 is slid manually by a user to engage the charging station 58. The charging station 58 charges the battery 56 when the patient lifting device 20 is not in use. The charging station 58 is disposed at one of the first and second beam ends 28, 30 of the transverse beam 26. The charging station 58 is electrically connected to a power source 60 to provide power to the charging station 58. The charging station 58 may include a plug that extends therefrom to be plugged in to an electrical outlet in a wall to communicate electrical power to the charging station 58.

Figure 6:
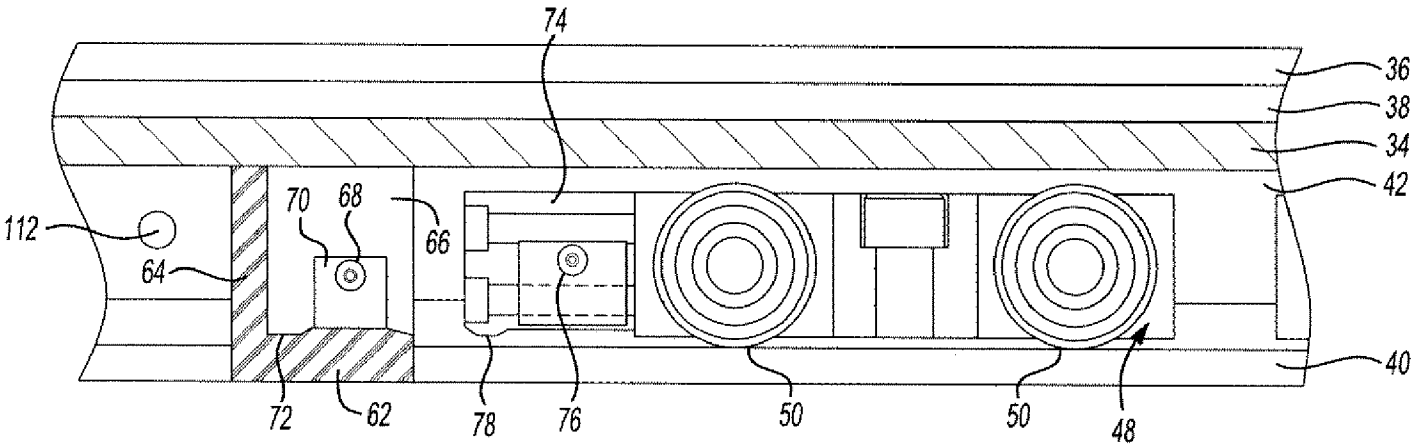
FIG. 6 is a partial cross-sectional side view of a charging station prior to receiving the plastic extension of the lift assembly according to the subject invention.
Figure 7:
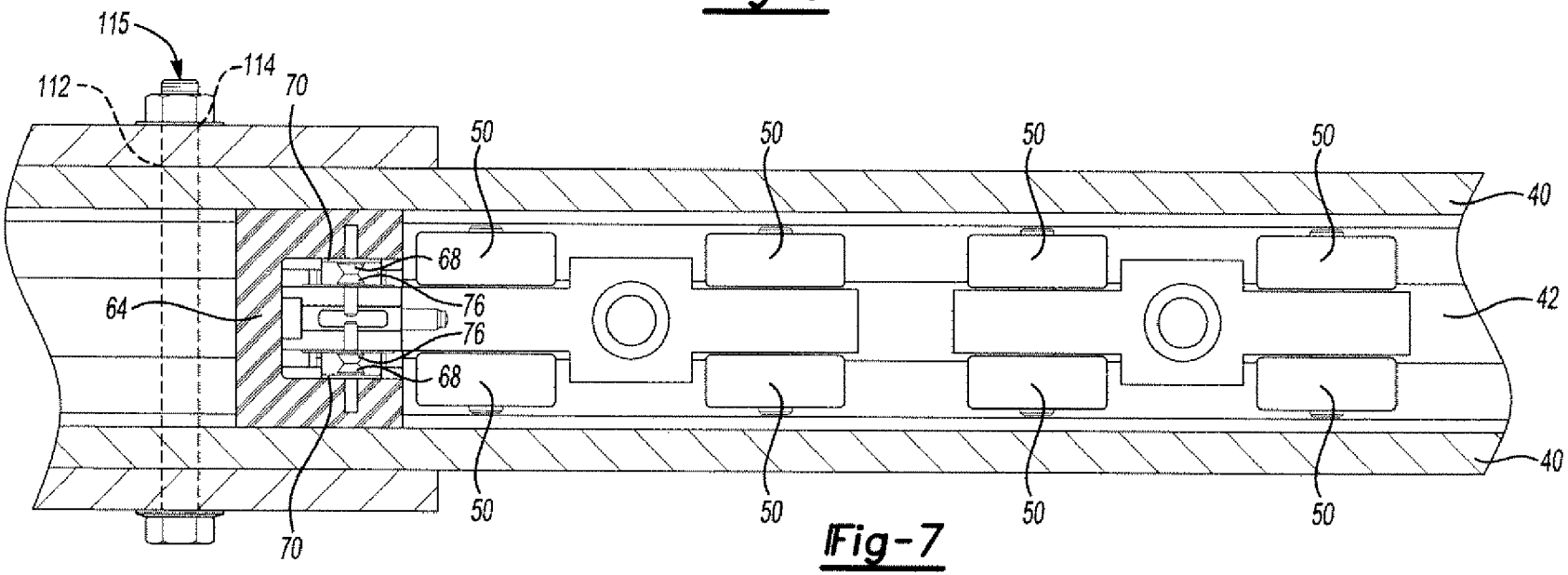
FIG. 7 is a partial plane view of the charging station having the plastic extension of the lift assembly engaged with the charging station to charge the battery of the lift assembly according to the subject invention.

In the exemplary embodiment, as shown in FIGS. 6-8, the charging station 58 includes a bottom wall 62 and three upwardly extending side walls 64. The three upwardly extending side walls 64 define an open end 66 that receives the lift assembly 48 to charge the battery 56 within the lift assembly 48. Once received within the charging station 58, the lift assembly 48 will give an indication that it is in position to receive a charge. This indication can include an audible clicking noise that occurs when the lift assembly 48 first engages the charging station 58. In addition, the lift assembly 48 may include an indicator, in the form of lights on the lift assembly 48, to show that the battery 56 is charging or charged.

The charging station 58 is disposed within the second channel 42 at one of the first and second beam ends 28, 30 of the transverse beam 26. In this position, a user can guide or slide the lift assembly 48 along the transverse beam 26 when the lift assembly 48 is not required to engage the charging station 58 and charge the battery 56 that powers the lift assembly 48. This allows for a patient lifting device 20 that requires minimal effort on the part of the user to recharge the battery 56 and thus increases the chances that the battery 56 will always be properly charged to power the motor 54 and lift assembly 48 when needed.

The charging station 58 includes a pair of charging contacts 68. The charging contacts 68 extend inwardly from the charging station 58 and are electrically connected to the power source 60 to receive electrical power from the power source 60. Each one of the pair of charging contacts 68 extends inwardly from opposing side walls 64 of the charging station 58. In the preferred embodiment, the charging contacts 68 are copper, but may be any suitable charging contact 68 known in the art. A plastic insulator 70 may be disposed between each of the charging contacts 68 and the side walls 64 to electrically insulate the charging contacts 68 from the charging station 58. The bottom wall 62 of the charging station 58 defines a positioning notch 72 that receives the lift assembly 48 to secure the lift assembly 48 relative to the charging station 58. The positioning notch 72 positions the lift assembly 48 relative to the charging contacts 68 to communicate electrical power from the charging station 58 to the lift assembly 48.

The lift assembly 48 may include a plastic extension 74 having a plurality nodules 76 that extend outwardly therefrom to engage the charging contacts 68. In the preferred embodiment, the nodules 76 are copper, but may be any suitable nodules 76 known in the art. The nodules 76 receive electrical power from the power source 60, via the charging station 58, to charge the battery 56. A wire harness is disposed within the plastic extension 74 of the lift assembly 48 and extends between the copper nodules 76 to the battery 56 to communicate the electrical power form the nodules 76 to the battery 56.

The lift assembly 48 may include a positioning knob 78 that extends downwardly from the plastic extension 74 to engage the positioning notch 72 of the charging station 58. When the positioning knob 78 is received in the positioning notch 72, the plurality of nodules 76 are position relative to the charging contacts 68 to communicate electrical power from the charging contacts 68 to the nodules 76. The receiving of the positioning knob 78 in the positioning notch 72 provides an audible clicking noise to indicate to the user that the lift assembly 48 is in the proper position to receive a charge.

In one exemplary embodiment, as seen in FIG. 1, the first and second support structures 22, 24 are a set height and may not be adjusted. Each of the support structures 22, 24 may include a base portion 80 that is disposed at the bottom of each support structure to provide a base to support each of the support structures 22, 24. A plurality of base plates 82 may be secured to the base portion 80, with each of the base plates 82 being adapted to receive a transfer wheel 84. A plurality of transfer wheels 84 or castors, with each of the transfer wheel 84 extending from one of the base plates 82, may be secured to each of the support structures 22, 24 to move the patient lifting device 20.

Figure 2:
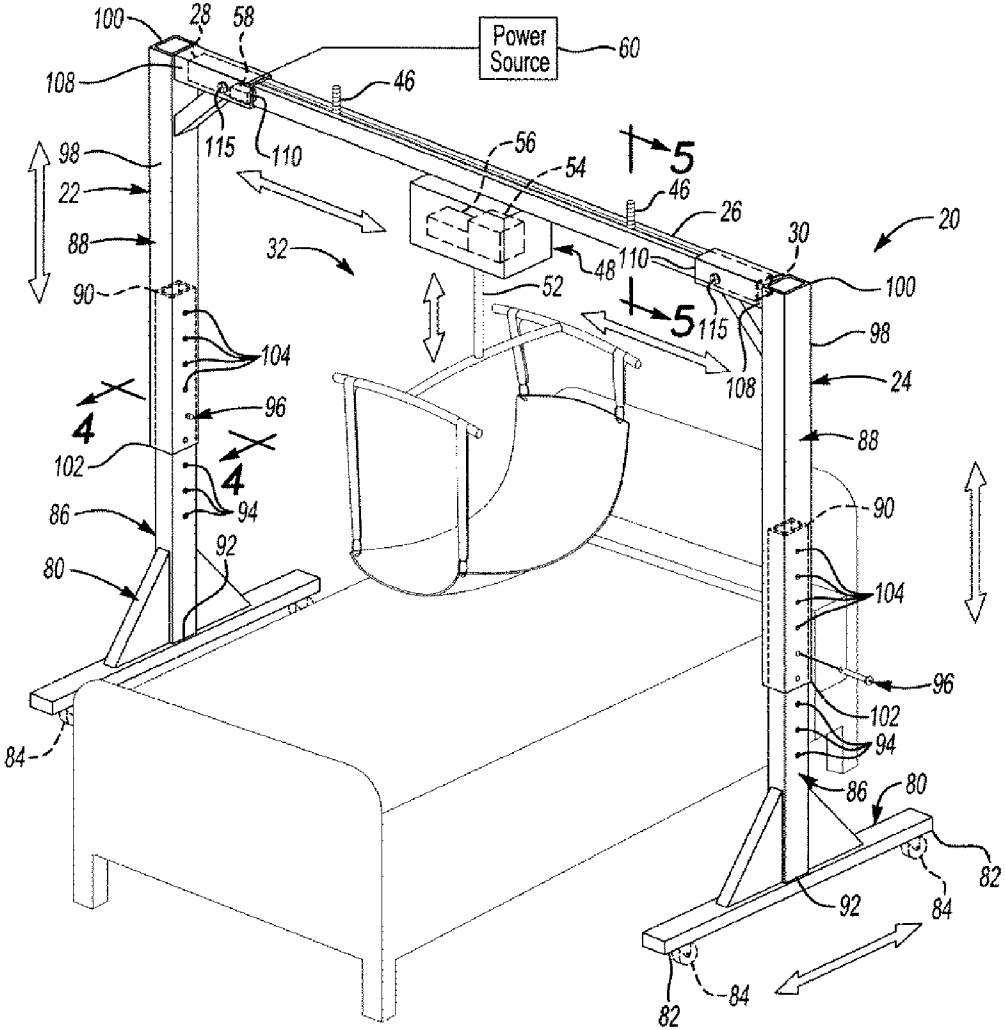
FIG. 2 is a perspective view of an exemplary patient lifting device having an upper support that is adjustable in relation to a lower support to adjust the height of the patient lifting device according to the subject invention.

In an alternative embodiment, as seen in FIG. 2, each of the first and second support structures 22, 24 include a lower support 86 and an upper support 88 that engages the lower support 86. The lower support 86 extends between a lower support top 90 and a lower support bottom 92. Each of the lower supports 86 include at least one first hole 94 or aperture that extends therethrough and that is sized to receive a locking pin 96. In the exemplary embodiment, the lower supports 86 are tubular and have a generally square cross section.

Each of the upper supports 88 include a vertical portion 98 that extends between an upper support top 100 and an upper support bottom 102. Each of the upper supports 88 include at least one second hole 104 or aperture that extends therethrough and is sized to receive the locking pin 96. The at least one second hole 104 in the upper support 88 is alignable with the at least one first hole 94 in the lower support 86 to secure the upper support 88 to the lower support 86. In the exemplary embodiment, the upper supports 88 are tubular and have a generally square cross section. The vertical portion 98 of the upper support 88 defines a support opening 106 area that is sized appropriate to receive the lower support 86. Once received, the at least one first hole 94 and the at least one second hole 104 are aligned to receive the locking pin 96. The locking pin 96 is inserted into the first and second holes 94, 104 to hold the vertical position of the lower support 86 relative to the upper support 88.

In an alternative embodiment, at least one of or both of the lower support 86 and upper support 88 may include a plurality of first or second holes 94, 104 that are spaced vertically along the lower or upper support 86, 88. Any one of the plurality of first holes 94 may align with any one of the plurality of second hole 104 depending on the desired vertical height of the transverse beam 26. As a result, the height of the patient lifting device 20 is adjustable based on the user's needs.

Each of the upper supports 88 include a horizontally extending portion 108 that extends horizontally from the vertical portion 98 adjacent the upper support top 100. The horizontally extending portion 108 engages the transverse beam 26. The horizontally extending portion 108 defines a beam opening 110 that is adapted to receive the transverse beam 26 within the beam opening 110. At least one third hole 112 extends through the horizontally extending portion 108 of the upper support 88 and is sized to receive a locking mechanism 115. At least one fourth hole 114 extends through the transverse beam 26 and is sized to receive the locking mechanism 115. The at least one fourth hole 114 aligns with the at least one third hole 112 when the upper support 88 engages the transverse beam 26 to secure the transverse beam 26 to the upper support 88. The locking mechanism 115 is inserted into the third and fourth holes 112, 114 to hold the horizontal position of the upper support 88 relative to the transverse beam 26. In the exemplary embodiment, the locking mechanism 115 is a nut having a bolt secured thereto to hold the horizontal position of the upper support 88 relative to the transverse beam 26, but may be any locking mechanism 115 known in the art to secure structures.

Figure 3:
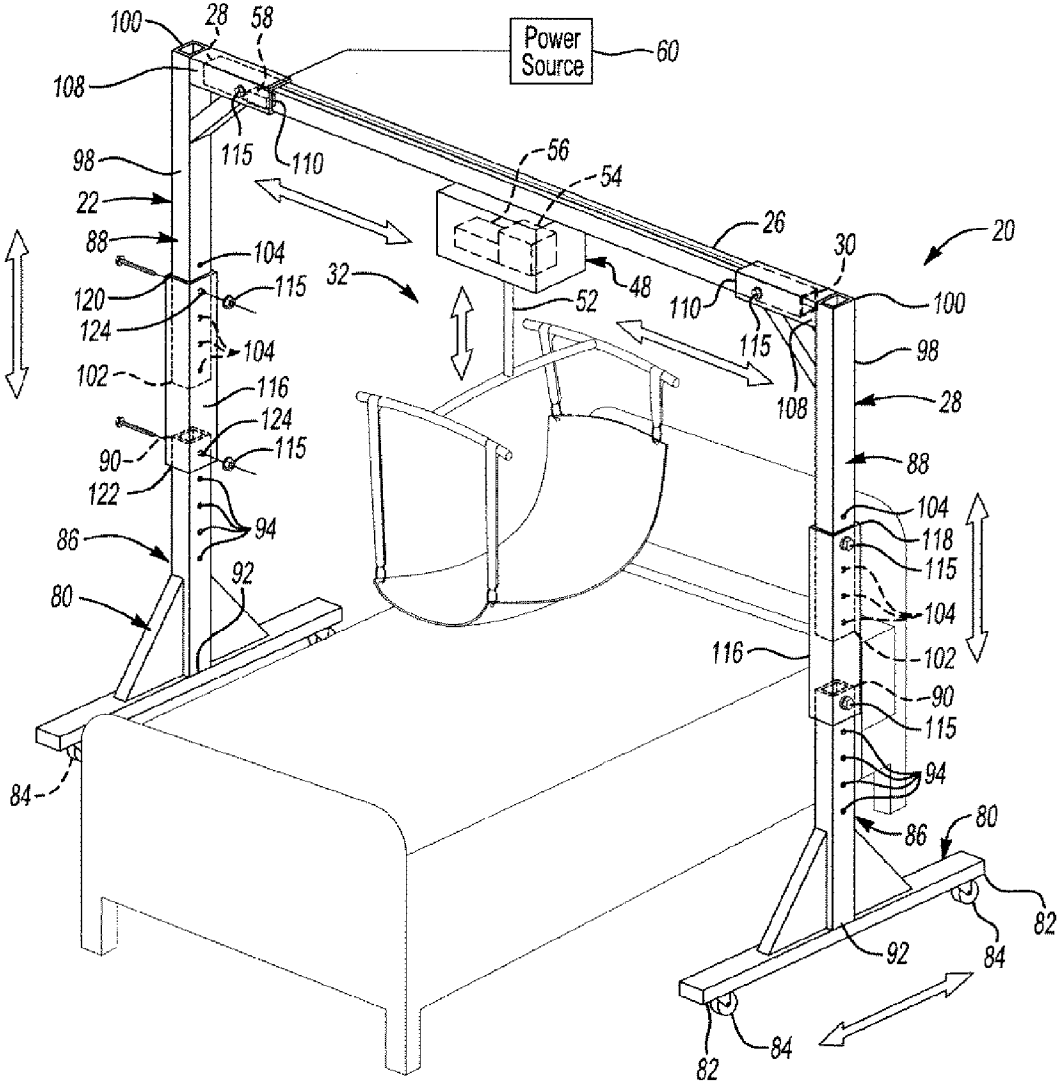
FIG. 3 is a perspective view of an exemplary patient lifting device having a support sleeve that positions an upper support relative to a lower support according to the subject invention.
Figure 4:
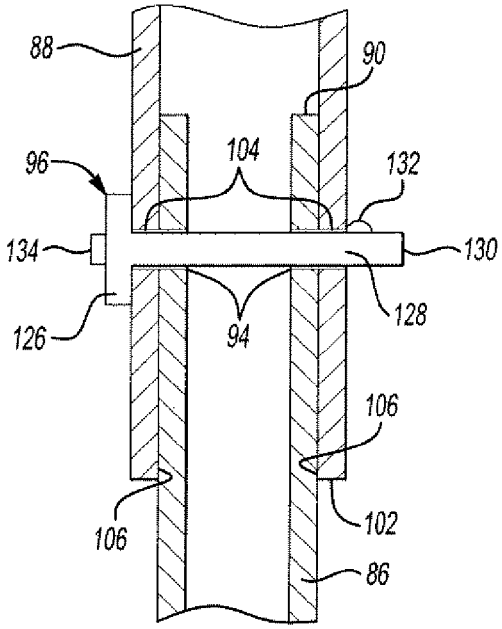
FIG. 4 is a cross-sectional view taken along the line 4-4 in FIG. 2 showing a locking pin securing the upper support to the lower support according to the subject invention.

In another exemplary embodiment, as seen in FIG. 3, a support sleeve 116 that defines a sleeve opening 118 extends between a sleeve top 120 and a sleeve bottom 122 to secure the upper support 88 relative to the lower support 86. The support sleeve 116 is tubular to receive the lower support 86 and the upper support 88 in the sleeve opening 118. The upper support 88 is received in the sleeve opening 118 at the sleeve top 120 and the lower support 86 is received in the sleeve opening 118 at the sleeve bottom 122.

At least two sleeve holes 124 extend through the support sleeve 116 and are sized to receive a locking mechanism 115. One of the sleeve holes 124 is disposed adjacent the sleeve top 120 and the other of the sleeve holes 124 is disposed adjacent the sleeve bottom 122. In operation, the at least one first hole 94 of the lower support 86 aligns with the one of the sleeve holes 124 that is disposed adjacent the sleeve bottom 122 to receive the locking mechanism 115 and secure the lower support 86 to the support sleeve 116. In the exemplary embodiment, the locking mechanism 115 is a nut having a bolt secured thereto to secure the lower support 86 to the support sleeve 116, but may be any locking mechanism 115 known in the art to secure structures. The at least one second hole 104 of the upper support 88 aligns with the one of the sleeve holes 124 that is disposed adjacent the sleeve top 120 to receive the locking mechanism 115 and secure the upper support 88 to the support sleeve 116. In the exemplary embodiment, the locking mechanism 115 is a nut having a bolt secured thereto to secure the upper support 88 to the support sleeve 116, but may be any locking mechanism 115 known in the art to secure structures. As a result, the support sleeve 116 secures the upper support 88 relative to the lower support 86.

A plurality of sleeve holes 124 may be spaced vertically along the support sleeve 116. The plurality of sleeve holes 124 allow the first and second holes 94, 104 of the lower and upper supports 86, 88 to align with any one of the plurality of sleeve holes 124. As a result, the height of the patient lifting device 20 may adjusted based on the user's needs.

The lower support 86 may include a base portion 80 that is disposed at the lower support bottom 92 to provide a base to support the support structures 22, 24. A plurality of base plates 82 may be secured to the base portion 80, with each of the base plates 82 being adapted to receive a transfer wheel 84 or castors. Each of the plurality of transfer wheels 84 extend from one of the base plates 82 to move the patient lifting device 20. In addition to transfer wheels 84, the base plates 82 may be adapted to receive a levelers.

The patient lifting device 20 includes a locking pin 96 to secure the components of the patient lifting device 20 to one another. In addition, utilizing the locking pin 96 instead of, for example, screws or bolts, facilitates quickly adjusting of the patient lifting device 20. For example, a user can quickly adjust the lower support 86 relative to the upper support 88 or separate the lower support 86 from the upper support 88. Vertical adjustments facilitate the accommodation of different ceiling heights and movement of the patient lifting device 20 between rooms, for example.

While the locking pin 96 is primarily discussed with respect to securing the first hole 94 to the second hole 104, it should be appreciated that the locking pin 96 can be used to secure the third hole 112 of the transverse beam 26 to the fourth hole 114 of the upper support 88 or the first or second holes 94, 104 of the lower and upper supports 86, 88 to the sleeve holes 124 of the support sleeve 116.

In the exemplary embodiment, the locking pin 96 extends through each of the first and second holes 94, 104 to secure the lower support 86 to the upper support 88. The locking pin 96 secures or holds the position of the lower support 86 relative to the upper support 88 when the locking pin 96 has been inserted through the first and second holes 94, 104.

While any locking pin 96 known in the art may be used, the exemplary locking pin 96 includes a head portion 126 and a pin portion 128. The head portion 126 has a diameter that is greater than the size of the first or second hole 94, 104 to limit the horizontal movement of the locking pin 96 into the first and second holes 94, 104. The pin portion 128 extends from the head portion 126 to a distal end 130 to be placed through the first and second holes 94, 104 and secure the lower support 86 to the upper support 88.

The locking pin 96 may include a bump portion 132 that is disposed adjacent the distal end 130 of the pin portion 128. The bump portion 132 is generally spherical and limits the horizontal movement of the locking pin 96 out of the first and second holes 94, 104. The bump portion 132 is movable between a retracted position that allows the locking pin 96 to move into and out of the first and second holes 94, 104 and an extended position that prohibits the horizontal movement of the locking pin 96 out of the first and second holes 94, 104. A button 134 may be disposed on the head portion 126 to control the movement of the bump portion 132 between the retracted position and the extended position to allow the locking pin 96 to be quickly inserted and removed as needed.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A patient lifting device for moving a patient relative to a bed or chair, comprising:

a first support structure and a second support structure spaced from said first support structure;

a transverse beam including a beam portion extending horizontally between a first beam end and a second beam end, one of said first and second beam ends engaging one of said first and second support structures and the other of said first and second beam ends engaging the other of said first and second support structures to define an open area between said transverse beam and said first and second support structures for placement of the patient;

a lift assembly engaging said beam support and capable of horizontal movement along said transverse beam and for moving the patient disposed in said open area vertically upward and downward relative to said transverse beam;

a pair of upwardly extending flanges extending upwardly from said beam portion between said first and second beam ends to define a first channel;

a pair of downwardly extending flanges extending downwardly from said beam portion between said first and second beam ends to define a second channel;

a battery capable of receiving a charge and carried by said lift assembly for powering said lift assembly to move the patient vertically upward and downward; and a charging station disposed within said second channel adjacent one of said first and second beam ends of said transverse beam for receiving said lift assembly;

said charging station including a bottom wall and three upwardly extending side walls to define an open end for receiving said lift assembly; and a power source electrically connected to said charging station for providing electrical power to said charging station to charge said battery when said lift assembly is received in said open end to power said lift assembly.

2. The patient lifting device as set forth in claim 1 wherein said lift assembly engages said transverse beam within said second channel for horizontal movement along said transverse beam in said second channel.

3. The patient lifting device as set forth in claim 2 wherein said lift assembly includes a plurality of assembly wheels disposed within said second channel of said transverse beam for guiding said lift assembly horizontally along said second channel of said transverse beam.

4. The patient lifting device as set forth in claim 1 further including a support plate secured within said first channel of said transverse beam for securing said transverse beam to a permanent structure and a mechanical fastener mating with said support plate for engaging the permanent structure to secure said transverse beam to the permanent structure.

5. The patient lifting device as set forth in claim 1 wherein said charging station further includes a pair of charging contacts extending inwardly from said charging station and being electrically connected to said power source for receiving electrical power from said power source.

6. The patient lifting device as set forth in claim 5 wherein said bottom wall defines a positioning notch for receiving said lift assembly to secure said lift assembly relative to said charging station and position said lift assembly relative to said charging contacts for communicating electrical power from said charging station to said lift assembly.

7. The patient lifting device as set forth in claim 6 wherein said lift assembly including a plastic extension having a plurality of nodules in electrical communication with said battery, said plurality of nodules extending outwardly from said plastic extension to engage said charging contacts for receiving electrical power from said power source via said charging contacts to charge said battery.

8. The patient lifting device as set forth in claim 7 wherein said lift assembly includes a positioning knob extending downwardly from said plastic extension for engaging said positioning notch of said charging station to position said plurality of nodules relative to said charging contacts to communicate electrical power from said charging contacts to said nodules.

9. The patient lifting device as set forth in claim 1 wherein each of said first and second support structures include a lower support extending between a lower support top and a lower support bottom and having at least one first hole extending therethrough, and an upper support having a vertical portion extending between an upper support top and an upper support bottom and having at least one second hole extending therethrough.

10. The patient lifting device as set forth in claim 9 wherein each of said upper and lower supports are tubular and one of said upper and lower supports defines a support opening for receiving the other of said upper and lower supports within said support opening, said at least one second hole aligning with said at least one first hole when said upper support engages said lower support, and further including a locking pin extending through said first and second holes for securing said lower support to said upper support.

11. The patient lifting device as set forth in claim 10 wherein at least one of said lower support and said upper support include a plurality of first or second holes spaced vertically along said lower or upper support for allowing at least one of said first and second holes of one of said lower support and said upper support to align with any one of said plurality of first or second holes of the other of said lower support and upper support for adjusting the height of the patient lifting device.

12. The patient lifting device as set forth in claim 9 wherein said lower support includes a base portion disposed at said lower support bottom for providing a base to support said support structures.

13. The patient lifting device as set forth in claim 12 further including a plurality of transfer wheels, with each of said transfer wheels extending from said base portion for moving the patient lifting device.

14. The patient lifting device as set forth in claim 1 wherein said first and second support structures are a set height and may not be adjusted.

15. The patient lifting device as set forth in claim 14 wherein each of said support structures include a base portion disposed at the bottom of each of said support structures to provide a base to support each of said support structures.

16. The patient lifting device as set forth in claim 15 further including a plurality of transfer wheels, with each of said transfer wheels extending from said base portion for moving the patient lifting device.

17. The patient lifting device as set forth in claim 1 further including a lift strap extending downwardly from said lift assembly for attaching to the patient to move the patient vertically upward and downward relative to said transverse beam.

18. The patient lifting device as set forth in claim 1 further including a motor for receiving power from said battery to power said lift assembly and move said lift assembly vertically upward and downward.

19. A patient lifting device for moving a patient relative to a bed or chair, comprising:

a first support structure and a second support structure spaced from said first support structure;

a transverse beam extending between a first beam end and a second beam end, one of said first and second beam ends engaging one of said first and second support structures and the other of said first and second beam ends engaging the other of said first and second support structures to define an open area between said transverse beam and said first and second support structures for placement of the patient;

each of said first and second support structures including a lower support extending between a lower support top and a lower support bottom and having at least one first hole extending therethrough;

each of said first and second support structures including an upper support having a vertical portion extending between an upper support top and an upper support bottom and having at least one second hole extending therethrough;

a horizontally extending portion extending horizontally from said vertical portion adjacent said upper support top to engage said transverse beam, wherein said horizontally extending portion defines a beam opening adapted to receive said transverse beam within said beam opening;

a lift assembly engaging said beam support and capable of horizontal movement along said transverse beam and for moving the patient disposed in said open area vertically upward and downward relative to said transverse beam;

a battery capable of receiving a charge and carried by said lift assembly for powering said lift assembly to move the patient vertically upward and downward; and a charging station disposed at one of said first and second beam ends of said transverse beam for receiving said lift assembly to charge said battery to power said lift assembly.

20. The patient lifting device as set forth in claim 19 further including at least one third hole extending through said horizontally extending portion of said upper support and at least one fourth hole extending though said transverse beam, wherein said at least one fourth hole aligns with said at least one third hole when said upper support engages said transverse beam, and a further including locking pin extending through said third and fourth holes for securing said transverse beam to said upper support.

21. A patient lifting device for moving a patient relative to a bed or chair, comprising:

a first support structure and a second support structure spaced from said first support structure;

a transverse beam extending between a first beam end and a second beam end, one of said first and second beam ends engaging one of said first and second support structures and the other of said first and second beam ends engaging the other of said first and second support structures to define an open area between said transverse beam and said first and second support structures for placement of the patient;

each of said first and second support structures including a lower support extending between a lower support top and a lower support bottom and having at least one first hole extending therethrough;

each of said first and second support structures including an upper support having a vertical portion extending between an upper support top and an upper support bottom and having at least one second hole extending therethrough;

a support sleeve being tubular and defining a sleeve opening extending between a sleeve top and a sleeve bottom for securing said upper support relative to said lower support, said upper support being received in said sleeve opening at said sleeve top and said lower support being received in said sleeve opening at said sleeve bottom;

a lift assembly engaging said beam support and capable of horizontal movement along said transverse beam and for moving the patient disposed in said open area vertically upward and downward relative to said transverse beam;

a battery capable of receiving a charge and carried by said lift assembly for powering said lift assembly to move the patient vertically upward and downward; and a charging station disposed at one of said first and second beam ends of said transverse beam for receiving said lift assembly to charge said battery to power said lift assembly.

22. The patient lifting device as set forth in claim 21 further including at least two sleeve holes extending through said support sleeve, at least one of said sleeve holes being disposed adjacent said sleeve top and at least one of said sleeve holes being disposed adjacent said sleeve bottom, wherein said at least one first hole of said lower support aligns with the at least one of said sleeve holes disposed adjacent said sleeve bottom and said at least one second hole of said upper support aligns with the at least one of said sleeve holes disposed adjacent said sleeve top, and further including a locking pin extending through each of said first and second holes and said corresponding sleeve hole for securing said lower support relative to said upper support.

* * * * *